US009454097B2

(12) United States Patent
Takahashi et al.

(10) Patent No.: US 9,454,097 B2
(45) Date of Patent: Sep. 27, 2016

(54) DEVELOPING DEVICE HAVING COMMUNICATION PORTION AND CONVEYING MEMBER TO CONVEY DEVELOPING AGENT

(71) Applicant: Brother Kogyo Kabushiki Kaisha, Nagoya-shi, Aichi-ken (JP)

(72) Inventors: Keisuke Takahashi, Nagoya (JP); Kazutoshi Kotama, Toyota (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/477,940

(22) Filed: Sep. 5, 2014

(65) Prior Publication Data

US 2015/0086248 A1 Mar. 26, 2015

(30) Foreign Application Priority Data

Sep. 25, 2013 (JP) ..... 2013-198744

(51) Int. Cl.
*G03G 15/08* (2006.01)

(52) U.S. Cl.
CPC ..... *G03G 15/0812* (2013.01); *G03G 15/0808* (2013.01)

(58) Field of Classification Search
CPC ..... G03G 15/0812; G03G 15/0808
USPC ..... 399/258, 281, 284
See application file for complete search history.

(56) References Cited

U.S. PATENT DOCUMENTS

| | | | | |
|---|---|---|---|---|
| 4,885,223 | A * | 12/1989 | Enoki et al. | 430/122.1 |
| 5,561,506 | A * | 10/1996 | Kasahara | 399/256 |
| 6,125,250 | A * | 9/2000 | Kamio et al. | 399/98 |
| 6,229,980 | B1 | 5/2001 | Ogawa et al. | |
| 2005/0111887 | A1* | 5/2005 | Choi et al. | 399/281 |
| 2011/0135344 | A1* | 6/2011 | Ebe | 399/281 |

FOREIGN PATENT DOCUMENTS

| | | | |
|---|---|---|---|
| JP | H11-249426 | A | 9/1999 |
| JP | 2000-162873 | A | 6/2000 |
| JP | 2005-156694 | A | 6/2005 |
| JP | 2007-114482 | A | 5/2007 |

* cited by examiner

*Primary Examiner* — Billy Lactaoen
(74) *Attorney, Agent, or Firm* — Banner & Witcoff, Ltd.

(57) ABSTRACT

A developing device includes a housing, a developing roller, a supply roller, a first regulating member, a second regulating member, a communication portion, and a conveying member. The second regulating member contacts with the supply roller. The housing has a first part and a second part. The first part is downstream of the second regulating member in a rotating direction of the supply roller, and a second part is upstream of the second regulating member in the rotating direction. The communication portion provides communication between the first part and the second part. The conveying member is in the first part and configured to convey the developing agent in the first part to the communication portion.

13 Claims, 8 Drawing Sheets

DEVELOPING DEVICE HAVING COMMUNICATION PORTION AND CONVEYING MEMBER TO CONVEY DEVELOPING AGENT

CROSS REFERENCE TO RELATED APPLICATION

This application claims priority from Japanese Patent Application No. 2013-198744 filed Sep. 25, 2013. The entire content of the priority application is incorporated herein by reference.

TECHNICAL FIELD

The present invention relates to a developing device provided in an electro-photographic type image forming apparatus.

BACKGROUND

A conventional electro-photographic type image forming apparatus includes an image carrier for carrying an electrostatic latent image, and a developing device for supplying developing agent to the electrostatic latent image on the image carrier.

Japanese Patent Application Publication No. H11-249426 discloses a developing device provided in such electro-photographic type image forming apparatus. The developing device includes a developing roller for supplying toner (developing agent) to a photosensitive body (image carrier), and a fur brush for supplying toner to the developing roller. The disclosed developing device also includes a layer thickness regulating member for adjusting a toner on a surface of the developing roller to a constant amount, and an elastic blade for maintaining a constant amount of toner on a surface of the fur brush. The adjusting member is in contact with the surface of the developing roller by a total length thereof in an axial direction, and the elastic blade is in contact with the surface of the fur brush by a total length thereof in the axial direction.

SUMMARY

With this structure, the toner scraped from the surface of the developing roller by the layer thickness regulating member may be accumulated in a space between the elastic blade and the layer thickness regulating member.

The toner released from the surface of the developing roller may include toner subjected to insufficient electrification, and the accumulation of such faultily electrified toner in the space between the elastic blade and the layer thickness regulating member may result in a printing failure called "fogging".

Therefore, it is an object of this invention to provide a developing device capable of stabilizing image formation.

In order to attain the above and other objects, the present invention provides a developing device that includes a housing, a developing roller, a supply roller, a first regulating member, a second regulating member, a communication portion, and a conveying member. The housing includes a developing agent reservoir that may be configured to accommodate a developing agent. The developing roller has an axis that may extend in a first direction and a first outer peripheral surface that may be configured to carry the developing agent thereon. The developing roller may be supported by the housing and rotatable about the axis in a first rotating direction. The supply roller includes a core member and a brush portion. The core member may have a second outer peripheral surface and extend in parallel to the axis. The core member may be supported by the housing and rotatable in a second rotating direction. The brush portion may contain fibers implanted on the second outer peripheral surface and may be configured to contact the developing roller to supply the developing agent in the developing agent reservoir to the developing roller. A contact portion may be defined between the brush portion and the developing roller. The first regulating member has a first fixed portion and a first contacting portion. The first fixed portion may be fixed to the housing. The first contacting portion may contact the first outer peripheral surface at a position downstream of the contact portion in the first rotating direction, and may be configured to regulate the developing agent on the first outer peripheral surface to a constant thickness. The second regulating member has a second fixed portion and a second contacting portion. The second fixed portion may be fixed to the housing. The second contacting portion may contact the brush portion at a position upstream of the contact portion in the second rotating direction. The second contacting portion may be configured to regulate the developing agent on the supply roller to a constant amount. The housing may have a first part positioned downstream of the second regulating member in the second rotating direction and a second part positioned upstream of the second regulating member in the second rotating direction. The communication portion may be configured to provide communication between the first part and the second part. The conveying member may be positioned in the first part and configured to convey the developing agent in the first part to the communication portion.

According to another aspect, the present invention provides a developing device that includes a housing, a developing agent reservoir, a developing roller, a supply roller, a first regulating member, a second regulating member, a communication portion, and a conveying member. The developing agent reservoir may be detachably supported by the housing and may be configured to accommodate a developing agent. The developing roller may be supported by the housing and rotatable about the axis in a first rotating direction. The supply roller includes a core member and a brush portion. The core member may have a second outer peripheral surface and extend in parallel to the axis. The core member may be supported by the housing and rotatable in a second rotating direction. The brush portion may contain fibers implanted on the second outer peripheral surface and may be configured to contact the developing roller to supply the developing agent in the developing agent reservoir to the developing roller. A contact portion may be defined between the brush portion and the developing roller. The first regulating member has a first fixed portion and a first contacting portion. The first fixed portion may be fixed to the housing. The first contacting portion may contact the first outer peripheral surface at a position downstream of the contact portion in the first rotating direction, and may be configured to regulate the developing agent on the first outer peripheral surface to a constant thickness. The second regulating member has a second fixed portion and a second contacting portion. The second fixed portion may be fixed to the housing. The second contacting portion may contact the brush portion at a position upstream of the contact portion in the second rotating direction. The second contacting portion may be configured to regulate the developing agent on the supply roller to a constant amount. The housing may have a first part positioned downstream of the second regulating member in the second rotating direction and a second part positioned upstream of the second regulating member in the second rotating direction. The communication portion may be configured to provide communication between the first part and the second part. The conveying member may be positioned in the first part and configured to convey the developing agent in the first part to the communication portion.

BRIEF DESCRIPTION OF THE DRAWINGS

The particular features and advantages of the invention as well as other objects will become apparent from the following description taken in connection with the accompanying drawings, in which.

DETAILED DESCRIPTION

1. Overall Structure of Developing Device

Figure 1:
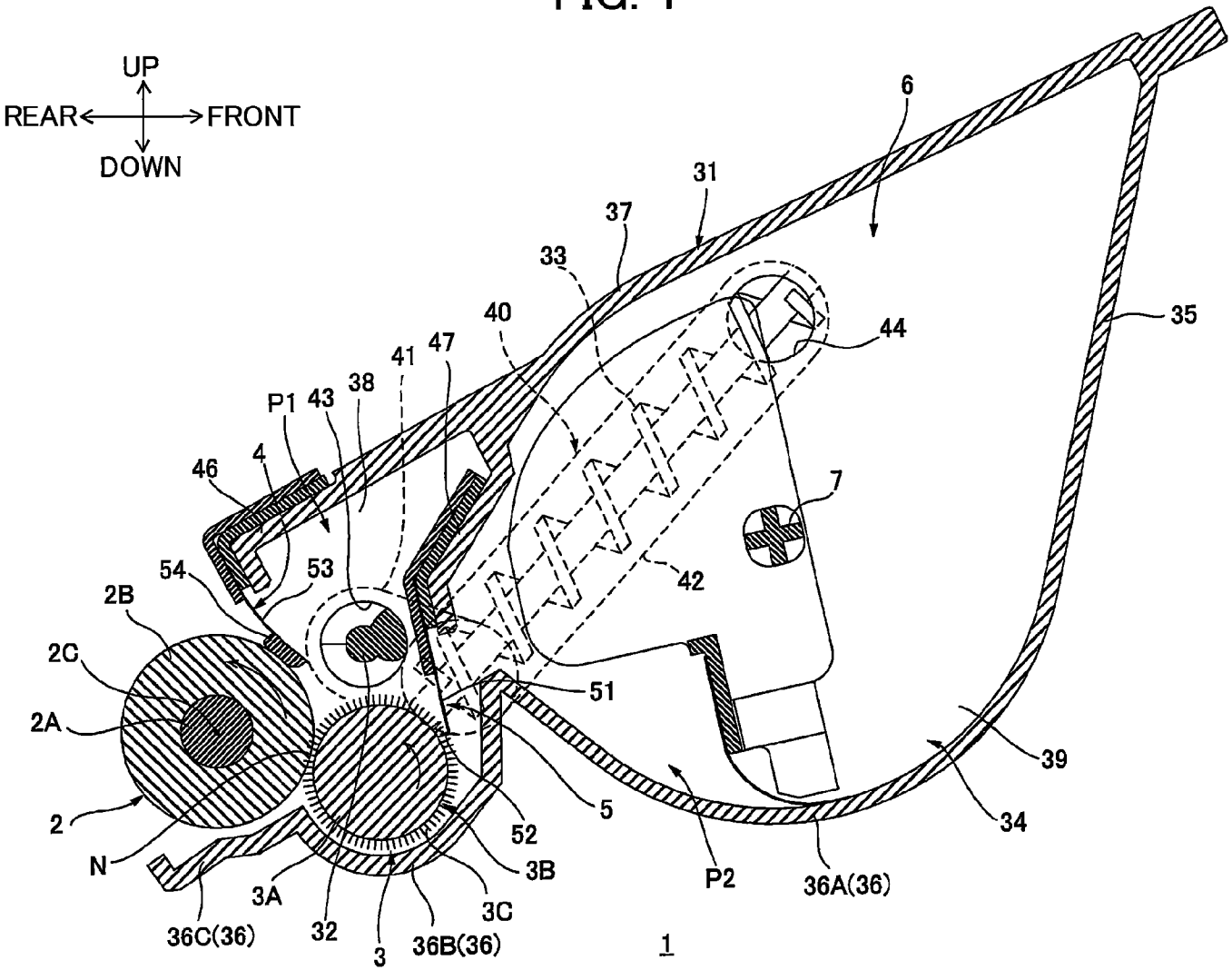
FIG. 1 is a central cross-sectional view of a developing unit as an developing device according to a first embodiment of the present invention.

A developing unit 1 as an example of a developing device according to a first embodiment of the present invention will be described with reference to FIGS. 1 and 2. The developing unit 1 has a developing roller 2, a supply roller 3, a thickness-regulating blade 4 as an example of a first regulating member, a second blade (toner amount regulating blade) 5 as an example of an second regulating member, and a toner accommodating portion 6 as an example of a developing agent reservoir.

Directions used in the following description in relation to the developing unit 1 will be referred to the state when the developing unit 1 is attached to a printer that will be described below, which defines the upper side and the lower side. Specifically, the upper side of FIG. 1 will be referred to as the "upper side", and the lower side of FIG. 1 as the "lower side". Further, the right side in FIG. 1 will be referred to as the "front side," and the left side as the "rear side." Further, left and right sides of the developing unit 1 in the following description will be based on the perspective of the user facing the front side of the printer 1. Thus, the near side of the developing unit 1 in FIG. 1 will be considered the "left side," and the far side will be considered the "right side." The leftward/rightward direction is an example of first directions, and the rightward direction is an example of one of the first directions.

The developing roller 2 is disposed in a rear end portion of the developing unit 1, and rotatable in a counterclockwise direction when viewed from the left side. The developing roller 2 includes a developing roller shaft 2A and a developing roller body 2B.

The developing roller shaft 2A has a substantially cylindrical shape, and extends in the leftward/rightward direction. In other words, developing roller shaft 2A has a center axis 2C extending in the leftward/rightward direction. The center axis 2C is an example of an axis. The developing roller shaft 2A is made from metal.

The developing roller body 2B has a substantially cylindrical shape, and extends in the leftward/rightward direction. The developing roller body 2B is made from electrically conductive rubber. The developing roller body 2B covers a center portion of the developing roller shaft 2A, while left and right end portions of the developing roller shaft 2A are uncovered.

The supply roller 3 is positioned frontward and downward of the developing roller 2. The supply roller 3 is rotatable in the counterclockwise direction when viewed from the left side. The supply roller 3 has a supply roller shaft 3A as an example of a core member, and a brush portion 3B.

The supply roller shaft 3A has a substantially cylindrical shape, and extends in the leftward/rightward direction parallel to the developing roller shaft 2A. The supply roller shaft 3A is made from metal.

The brush portion 3B has electrically conductive fibers 3C as examples of fibers implanted on an outer peripheral surface of the supply roller shaft 3A. The brush portion 3B covers a center portion of the supply roller shaft 3A in the leftward/rightward direction, while left and right end portions of the supply roller shaft 3A are uncovered. The brush portion 3B is in contact with a front lower end portion of the developing roller body 2B.

The thickness-regulating blade 4 is positioned frontward and upward of the developing roller 2. The thickness-regulating blade 4 is in contact with a front end portion of the developing roller body 2B.

The second blade 5 is disposed frontward and upward of the supply roller 3. The second blade 5 is in contact with a front end portion of the brush portion 3B.

The toner accommodating portion 6 is positioned frontward of the supply roller 3 and the second blade 5. The toner accommodating portion 6 is configured to accommodate therein a toner as an example of a developing agent. The toner is a positively-chargeable non-magnetic single component type polymerized toner as an example of a chemical toner. Such polymerized toner is produced by a method described in Japanese Patent Application Publication No. 2008-186002. More specifically, the polymerized toner is obtained by blending together in a liquid phase a first polymerizable monomer, a charge-control resin, and a toner core particle. The first polymerizable monomer includes cationic radical. The charge-control resin is obtained by copolymerization of the first polymerizable monomer with a second polymerizable monomer copolymerizable therewith. The toner core particle contains coloring agent. The toner accommodating portion 6 is provided with an agitator 7.

The agitator 7 is rotatably supported in the toner accommodating portion 6.

2. Overall Structure of Printer Provided with the Developing Device

The image forming apparatus 11 is an electrophotographic type monochromatic printer, and has a main frame 12, a process unit 13, a scanner unit 14, and a fixing unit 15. As illustrated in FIG. 2, the developing unit 1 is attached to the main frame 12.

The main frame 12 has a substantially box shape, and has an opening 16, a front cover 17, a sheet supply tray 18, and a discharge tray 19.

The opening 16 is positioned at a front end portion of the main frame 12. The opening 16 permits communication between an interior and an exterior of the main frame 12 in the frontward/rearward direction so as to allow the process unit 13 to pass therethrough.

The front cover 17 is positioned at a front end portion of the main frame 12, and is generally plate shaped. The front cover 17 extends in the upward/downward direction, and has a lower end portion pivotally movably connected to a front wall of the main frame 12 for opening and closing the opening 16.

The sheet supply tray 18 is placed at a bottom portion of the main frame 12, and configured to accommodate sheets P.

The discharge tray 19 is provided at a rear half portion of an upper wall of the main frame 12. The discharge tray 19 is recessed downward from an upper face of the main frame 12 so that the sheets P can be accommodated thereon.

The process unit 13 is positioned in a substantially center portion in the upward/downward direction of the main frame 12. The process unit 13 includes a drum unit 20 and the developing unit 1.

The drum unit 20 includes a photosensitive drum 21, a scorotron charger 22, and a transfer roller 23.

The photosensitive drum 21 is rotatably supported to a rear end portion of the drum unit 20.

The scorotron charger 22 is positioned rearward of and away from the photosensitive drum 21.

The transfer roller 23 is disposed below the photosensitive drum 21, and in contact with a lower end portion of the photosensitive drum 21.

The developing unit 1 is disposed forward of the photosensitive drum 21 and in contact with a front end portion of the photosensitive drum 21.

The scanner unit 14 is positioned above the process unit 13. The scanner unit 14 is configured to emit a laser beam corresponding to image data to the photosensitive drum 21.

The fixing unit 15 is positioned rearward of the process unit 13. The fixing unit 15 includes a heat roller 24, and a pressure roller 25 in pressure contact with a rear lower end portion of the heat roller 24.

During an image forming operation of the image forming apparatus 11, the scorotron charger 22 uniformly charges a surface of the photosensitive drum 21. Next, the surface of the photosensitive drum 21 is exposed to the laser beam emitted from the scanner unit 14. Accordingly, an electrostatic latent image corresponding to image data is formed on the surface of the photosensitive drum 21.

On the other hand, the agitator 7 agitates toner in the toner accommodating portion 6 so as to supply the toner to the supply roller 3. The supply roller 3 conveys the toner supplied by the agitator 7 to the developing roller 2. Simultaneously, the toner is charged with a positive polarity by the triboelectric charging between the developing roller 2 and the supply roller 3, and held by the developing roller 2. The thickness-regulating blade 4 regulates the thickness of the toner on the developing roller 2 to a constant thickness.

Subsequently, the toner on the developing roller 2 is supplied to the electrostatic latent image on the surface of the photosensitive drum 21. Accordingly, a toner image is formed and carried on the surface of the photosensitive drum 21.

Upon rotations of various rollers, each of the sheets P is conveyed from the sheet supply tray 18 to the contacting part of the photosensitive drum 21 and the transfer roller 23 in a prescribed timing. The toner image on the surface of the photosensitive drum 21 is transferred to the sheet P, as the sheet P passes through between the photosensitive drum 21 and the transfer roller 23.

Subsequently, the sheet P is pressed and heated, when passing through between the heat roller 24 and the pressure roller 25. As a result, the toner image on the sheet P is thermally fixed thereon, and the sheet P is then discharged onto the discharge tray 19.

3. Details of the Developing Unit

(1) Developing Unit Frame

Figure 2:
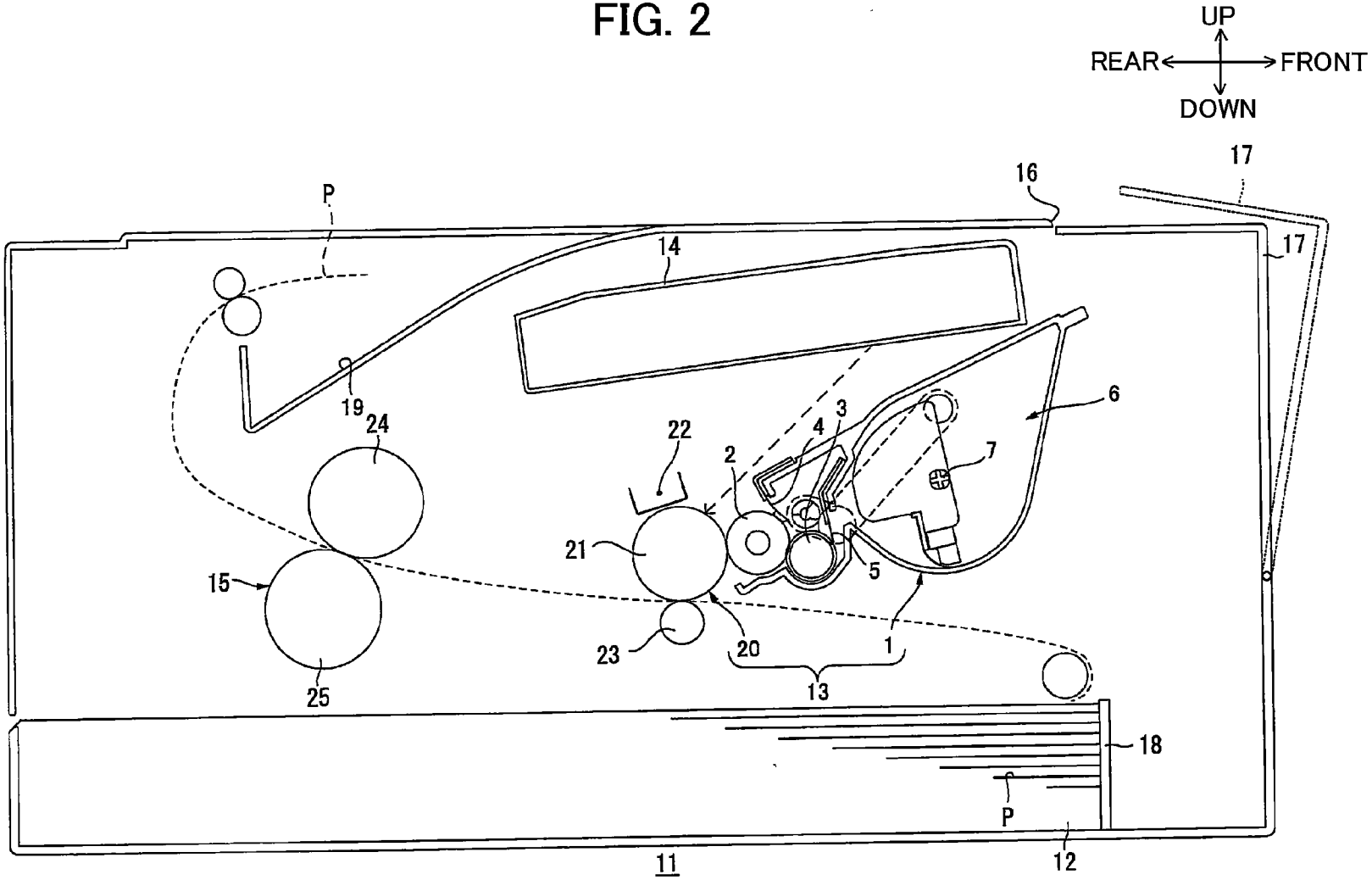
FIG. 2 is a central cross-sectional view of a printer provided with the developing unit shown in FIG. 1.

As depicted in FIG. 1, the developing unit 1 includes a developing unit frame 31 as an example of a housing.

The developing unit frame 31 is substantially box shaped, and has a rear open end. The developing unit frame 31 is an integral member including a pair of side walls 34, a lower wall 36, front wall 35, and upper wall 37.

The side walls 34 are right and left end portions of the developing unit frame 31. Each of the pair of the side walls 34 has a substantially plate shape extending in frontward/rearward direction, and includes a first wall 38 and a second wall 39.

The first wall 38 occupies a rear half portion of the side wall 34, and is positioned rearward of the toner accommodating portion 6. The first wall 38 rotatably supports right and left end portions of the developing roller shaft 2A and right and left end portions of the supply roller shaft 3A.

The second wall 39 occupies a front half portion of the side wall 34. The second walls 39 serve as left and right side walls of the toner accommodating portion 6, and rotatably support left and right end portions of the agitator 7.

The lower wall 36 constitutes a lower end portion of the developing unit frame 31. The lower wall 36 is an integral component including a first wall 36A, a second wall 36B, and a third wall 36C.

The first wall 36A constitutes a front half portion of the lower end portion of the developing unit frame 31.

The first wall 36A has a generally arcuate-shaped cross-section, and also has a center portion in the frontward/rearward direction protruding downward. The first wall 36A has left and right end portions each being continuous with each of lower end portions of the second walls 39 of the pair of the side walls 34. The first wall 36A forms a bottom wall of the toner accommodating portion 6.

The second wall 36B is positioned rearward of the first wall 36A, and has a generally arcuate-shaped cross-section. The second wall 36B is integral with and extends rearward from a rear end portion of the first wall 36A, curving along an outer peripheral surface of the supply roller 3. The second wall 36B has left and right end portions each being continuous with each of front lower end portions of each of the first walls 38.

The third wall 36C is positioned rearward of the second wall 36B. The third wall 36C has a generally linear cross-section. The third wall 36C is integral with and extends rearward from a rear end portion of the second wall 36B. The third wall 36C has left and right end portions each being continuous with each of rear lower end portions of each first wall 38.

The front wall 35 constitutes a front end portion of the developing unit frame 31. The front wall 35 has a substantially plate shape extending upward from a front end portion of the lower wall 36. The front wall 35 has left and right end portions each being continuous with each of front end portions of each second wall 39. The front wall 35 serves as a front wall of the toner accommodating portion 6.

The upper wall 37 constitutes an upper end portion of the developing unit frame 31. The upper wall 37 is substantially plate-shaped, and extends in the frontward/rearward direction. The upper wall 37 has a front end portion continuous with an upper end portion of the front wall 35. The upper wall 37 has left and right end portions each being continuous with each of upper end portions of each of the pair of the side walls 34. The upper wall 37 supports a thickness-regulating blade support portion 46 and a second blade support portion 47.

The thickness-regulating blade support portion 46 is disposed at a rear end portion of the upper wall 37, and extends in the frontward/rearward direction. The thickness-regulating blade support portion 46 has a plate shape that forms a substantially L-shaped cross-section bending downward at a rear end portion thereof. The thickness-regulating blade support portion 46 supports the thickness-regulating blade 4.

The thickness-regulating blade 4 includes a main portion 53, and a contact part 54 as an example of a first contacting portion.

The main portion 53 has a plate shape extending in the upward/downward direction and elongated in the leftward/rightward direction. The main portion 53 has an upper end portion fixed to a rear face of a rear end portion of the thickness-regulating blade support portion 46, and also has a lower end portion facing a front upper end portion of the developing roller body 2B. The upper end portion of the main portion 53 is an example of a first fixed portion.

The contact part 54 is positioned at a rear face of a lower end portion of the main portion 53. The contact part 54 extends in the leftward/rightward direction, and has a curved rear end portion forming a generally arcuate cross-section. The contact part 54 is in contact with a front upper end portion of the developing roller body 2B. That is, the contact part 54 is in contact with the developing roller body 2B at a position downstream of a contact portion N in the rotating direction of the developing roller 2. Here, the contact portion N is a contacting portion between the developing roller 2 and the supply roller 3, and the rotating direction is the counterclockwise direction when viewed from the left side of the developing roller body 2B.

The second blade support portion 47 is positioned at a substantially intermediate portion of the upper wall 37 in the frontward/rearward direction. The second blade support portion 47 has a plate shape forming a generally crank-shaped cross-section extending from a lower face of the upper wall 37 and bending downward. The second blade support portion 47 has left and right end portions each being continuous with each of interior faces in the leftward/rightward direction of each of the pair of the side walls 34. The second blade support portion 47 has a lower end portion positioned rearward and upward of a rear end portion of the first wall 36A, and the lower end portion of the second blade support portion 47 is spaced away from the rear end portion of the first wall 36A. The second blade support portion 47 supports the second blade 5.

The second blade 5 integrally includes a main portion 51 and a regulation portion 52 as an example of a second contacting portion.

The main portion 51 has a plate shape extending in the upward/downward direction and elongated in the leftward/rightward direction. The main portion 51 has an upper end portion fixed to a front face of a rear end portion of the second blade support portion 47, and has a lower end portion whose rear side faces a front upper end portion of the supply roller 3. That is, the main portion 51 extends from the second blade support portion 47 to the supply roller 3. The upper end portion of the main portion 51 is an example of a second fixed portion.

The regulation portion 52 has a generally L-shaped cross-section extending from a lower end portion of the main portion 51 and bending toward the supply roller shaft 3A. The regulation portion 52 has a free end portion entering the brush portion 3B. That is, regulation portion 52 is in contact with the brush portion 3B at a position upstream of the contact portion N in the rotating direction of the supply roller 3. Here, the contact portion N is a contacting portion between the developing roller 2 and the supply roller 3, and the rotating direction is the counterclockwise direction when viewed from the left side of the supply roller 3.

The developing unit frame 31 forms a first part P1, which is an area surrounded by the developing roller 2, the supply roller 3, the thickness-regulating blade 4, the second blade 5, the pair of the side walls 34, and the upper wall 37. Additionally, the developing unit frame 31 forms a second part P2, which is an area forward of the second blade 5 in the developing unit frame 31.

(2) Conveyance of Toner

The developing unit 1 further includes a conveying unit 40 as an example of a communication portion, and a first screw 32 as an example of a conveying member.

The conveying unit 40 is disposed outward of the right side wall 34, i.e. rightward of the right side wall 34. The conveying unit 40 includes a first opening 43, a second opening 44, a first conveying portion 41, a second conveying portion 42, and a second screw 33 as an example of a second conveying member.

The first opening 43 is located at a substantially intermediate portion of the right first wall 38 in the upward/downward direction, and is positioned forward and upward of the developing roller 2 and above the supply roller 3. The first opening 43 is substantially circular shaped, and penetrates the right first wall 38 in the leftward/rightward direction.

The second opening 44 is positioned at an upper end portion of a substantially intermediate portion in the frontward/rearward direction of the right second wall 39. The second opening 44 is generally circular shaped, and penetrates the right second wall 39 in the leftward/rightward direction.

The first conveying portion 41 has a generally cylindrical shape extending forward and downward from a peripheral portion of the first opening 43. The first conveying portion 41 has a rear upper end portion communicating with the first opening 43.

The second conveying portion 42 is generally cylindrical shaped. The second conveying portion 42 is continuous with a front lower end portion of the first conveying portion 41, and extends forward and upward. The second conveying portion 42 has a rear lower end portion communicating with the front lower end portion of the first conveying portion 41, and has a front upper end portion communicating with the second opening 44. Accordingly, the conveying unit 40 provides communication between the first part P1 and the upper end portion of the toner accommodating portion 6, i.e. the second part P2.

The second screw 33 is disposed in the second conveying portion 42. The second screw 33 is an auger screw extending in the rear downward/front upward direction. The second screw 33 has a front upper end portion that is rotatably supported by a front upper wall of the second conveying portion 42, and has a rear lower end portion that is rotatably supported by a rear lower wall of the second conveying portion 42.

The first screw 32 is positioned frontward of the developing roller 2 and above the supply roller 3. The first screw 32 is an auger screw extending in the leftward/rightward direction. The first screw 32 has a left end portion rotatably supported by the left side wall 34, and has a right end portion rotatably supported by the right wall of the first conveying portion 41.

4. Operation of the Developing Unit

Upon starting operation of the image forming apparatus 11, toner in the toner accommodating portion 6 is supplied to the supply roller 3 by the agitator 7.

Next, the toner is carried by the brush portion 3B. Part of the toner carried by the brush portion 3B is scraped by the regulation portion 52 to be regulated to a constant amount.

Subsequently, the toner that is not scraped by the regulation portion 52 but remaining on the brush portion 3B is charged with a positive polarity by the triboelectric charging at the contact portion N between the developing roller 2 and the supply roller 3. The toner is then carried on a surface of the developing roller body 2B.

The toner on the developing roller body 2B is regulated to a constant thickness by the contact part 54 of the thickness-regulating blade 4, as developing roller 2 rotates in the counterclockwise direction when viewed from the left side.

Simultaneously, the toner scraped from the surface of the developing roller body 2B is accumulated around the contact portion N between the developing roller 2 and the supply roller 3. That is, the toner is accumulated in the first part P1.

The toner accumulated around the contact portion N is conveyed rightward by the first screw 32, and then supplied to the first conveying portion 41 through the first opening 43.

The toner supplied to the first conveying portion 41 is moved by gravity to the rear lower end portion of the second conveying portion 42, and then is conveyed forward and upward by the second screw 33. Thus, the toner is supplied to the upper end portion of the toner accommodating portion 6, i.e. the second part P2, through the second opening 44.

5. Operational Advantages (1) In the developing unit 1 according to the embodiment described above, as shown in FIG. 1, the toner scraped by the thickness-regulating blade 4 is conveyed by the first screw 32 to the conveying unit 40 from the first portion P1 positioned downstream of the second blade 5 in the rotating direction of the supply roller 3. Consequently, the toner can be returned to the toner accommodating portion 6 positioned upstream of the second blade 5 in the rotating direction of the supply roller 3 through the conveying unit 40.

Accordingly, the accumulation of the toner scraped by the thickness-regulating blade 4 in the first part P1 can be suppressed. Therefore, the accumulation of the toner subjected to insufficient electrification in the first part P1 can be suppressed, and the image formation can be stabilized.

(2) As shown in FIG. 1, the developing unit 1 includes the conveying unit 40, which provides communication between the first part P1 and the upper end portion of the toner accommodating portion 6. Thus, the toner in the first part P1 can be returned to the upper end portion of the toner accommodating portion 6. Consequently, the return process of the toner in the first part P1 to the toner accommodating portion 6 can be smoothly carried out without being affected by the accommodation amount of the toner in the toner accommodating portion 6.

(3) In the developing unit 1, the conveying unit 40 is positioned at the right end portion of the developing unit frame 31, and the first screw 32 conveys the toner in the first part P1 rightward. Thus, the toner in the first part P1 can be collected rightward. As a result, the toner in the first part P1 can be further efficiently returned to the toner accommodating portion 6.

(4) As shown in FIG. 1, the developing unit 1 further includes the second screw 33 positioned in the second conveying portion 42 of the conveying unit 40 for conveying the toner in the conveying unit 40 to the toner accommodating portion 6. Therefore, the toner conveyed to the conveying unit 40 can be surely conveyed to the toner accommodating portion 6 by the second screw 33.

(5) The toner employed in the developing unit 1 is a chemical toner that is manufactured by polymerizing polymerizable monomers. Because of the employment of the chemical toner that has a good fluidity, the amount of the toner carried on the supply roller 3 can be easily adjusted. Specifically, the second blade 5 can facilitate regulation of the toner amount. That is, the second blade 5 can suppress excessive invasion of the toner into the brush portion 3B, and thus generation of excessive torque at the contact portion N between the developing roller 2 and the supply roller 3 can be suppressed. Consequently, the image formation can be further stabilized.

(6) As shown in FIG. 1, the second blade 5 in the developing unit 1 has the main portion 51 extending to the supply roller 3, and the regulation portion 52. The regulation portion 52 continuous with the main portion 51 is bent toward the supply roller shaft 3A, and is entered into the brush portion 3B. Accordingly, part of the toner on the brush portion 3B can be surely scraped by the regulation portion 52 entering the brush portion 3B. As a result, the toner amount on the brush portion 3B can be uniformly regulated, and thus a further stabilized image formation can be obtained. Moreover, the torque at the contact portion N can be reduced.

6. Second Embodiment

A developing unit 61 according to a second embodiment of the present invention will next be described with reference to FIGS. 3 and 4 wherein like parts and components are designated by the same reference numerals as those shown in FIGS. 1 and 2 to avoid duplicating description.

(1) Outline of the Second Embodiment

Figure 3:
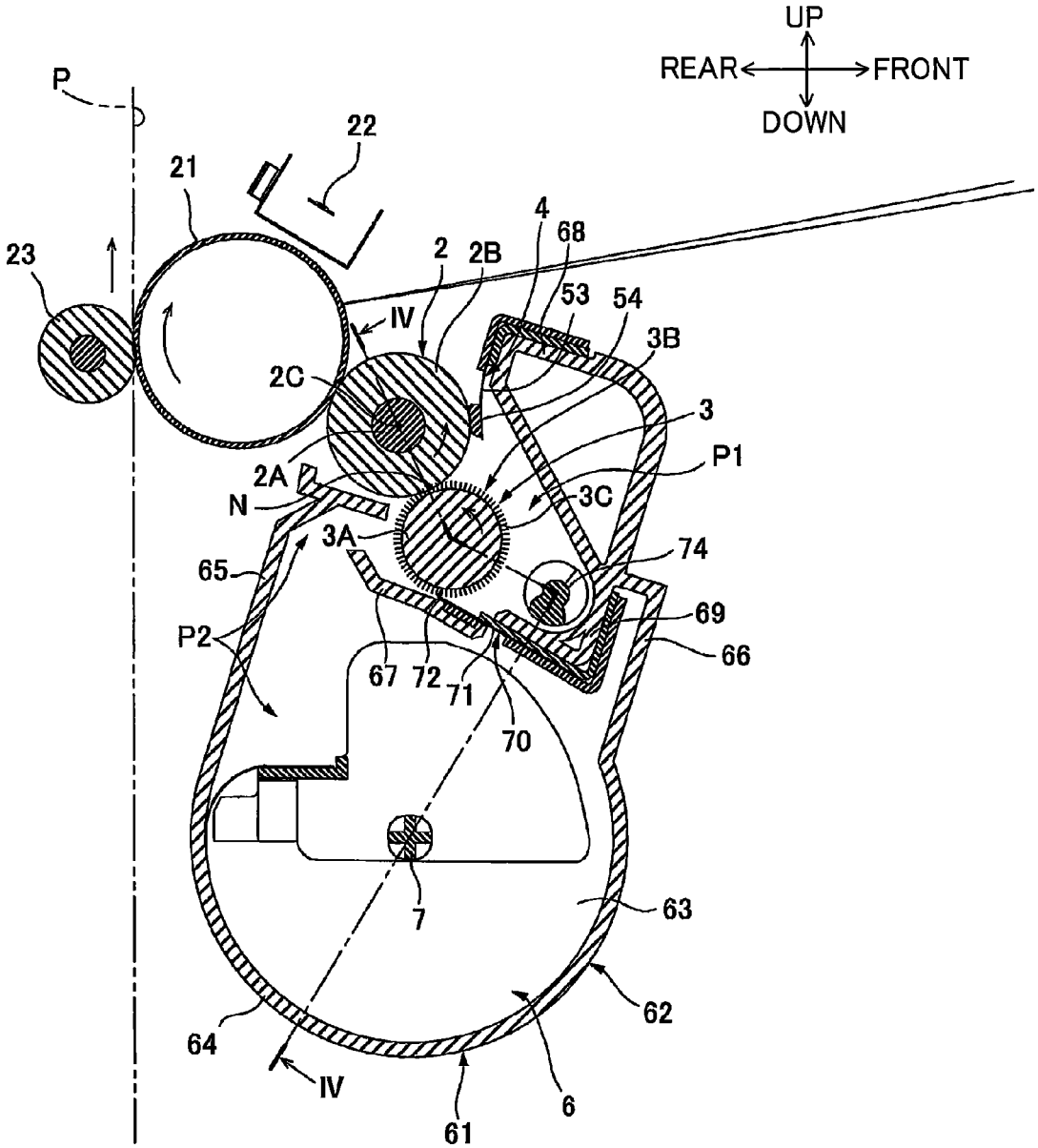
FIG. 3 is a view for description of a developing unit according to a second embodiment of the present invention.

The developing unit 61 according to the second embodiment provides the toner accommodating portion 6 below the supply roller 3 as shown in FIG. 3, whereas the developing unit 1 according to the first embodiment provides the toner accommodating portion 6 frontward of the supply roller 3.

The developing unit 61 according to the second embodiment is applied to an image forming apparatus that conveys the sheet P upward, while the developing unit 1 according to the first embodiment is applied to the image forming apparatus 11 that conveys the sheet P rearward.

(2) Detailed Structure of the Developing Unit (2-1) Developing Unit Frame

Figure 4:
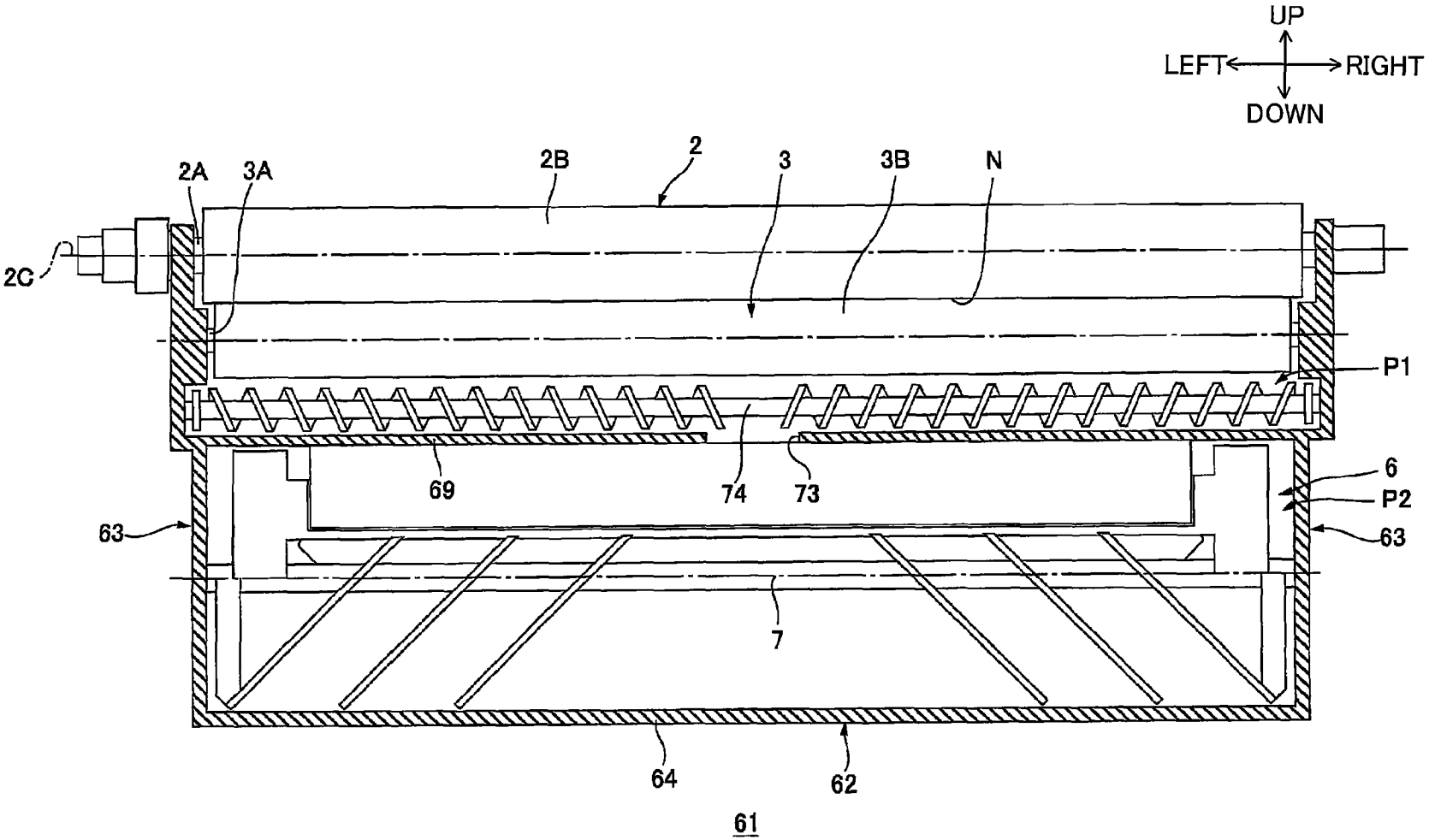
FIG. 4 is a cross-sectional view of the developing unit taken along a line IV-IV in FIG. 3.

The developing unit 61 includes a developing unit frame 62 as an example of a housing, as shown in FIGS. 3 and 4. The developing unit frame 62 is substantially box shaped and has an upper open end. The developing unit frame 62 is an integral member including a pair of side walls 63, a lower wall 64, a rear wall 65, a front wall 66, and a partition wall 67.

The pair of side walls 63 are right and left end portions of the developing unit frame 62, and each side wall 63 has a substantially plate shape extending in the vertical direction. Each side wall 63 has a rear upper end portion rotatably supporting the developing roller shaft 2A. Further, each side wall 63 has a front lower end portion rotatably supporting the supply roller shaft 3A so that the brush portion 3B is in contact with the front lower end portion of the developing roller body 2B.

The lower wall 64 constitutes a rear lower end portion of the developing unit frame 62. The lower wall 64 has a generally arcuate-shaped cross-section. The lower wall 64 has an intermediate portion in the frontward/rearward direction protruding downward, and has left and right end portions each being in continuous with each lower end portion of each side wall 63.

The rear wall 65 constitutes a rear end portion of the developing unit frame 62. The rear wall 65 has a generally plate shape extending upward from and continuous with the rear end portion of the lower wall 64. The rear wall 65 has left and right end portions each being continuous with each of rear end portions of the pair of the side walls 63.

The front wall 66 constitutes a front end portion of the developing unit frame 62. The front wall 66 has a substantially plate shape extending upward from and continuous with a front end portion of the lower wall 64. The front wall 66 has left and right end portions each being continuous with each of front end portions of the pair of the side walls 63. The front wall 66 has a thickness-regulating blade support portion 68 and a second blade support portion 69.

The thickness-regulating blade support portion 68 is positioned at an upper end portion of the front wall 66, and has a generally triangular cross-section having a rear vertex portion. The thickness-regulating blade support portion 68 supports the thickness-regulating blade 4.

The thickness-regulating blade 4 has a main portion 53 and a contact part 54. The main portion 53 has an upper end portion fixed on a rear face of the upper end portion of the front wall 66. The contact part 54 is in contact with a front upper end portion of the developing roller body 2B. That is, the contact part 54 is in contact with the developing roller body 2B at a position downstream of a contact portion N in the rotating direction of the developing roller 2. Here, the contact portion N is a contacting portion between the developing roller 2 and the supply roller 3.

The second blade support portion 69 is positioned at a substantially intermediate portion in the upward/downward direction of the front wall 66. The second blade support portion 69 has a plate shape that forms a substantially L-shaped cross-section extending downward from a lower end portion of the thickness-regulating blade support portion 68 and bending rearward. The second blade support portion 69 has left and right end portions each being continuous with each of interior faces in the leftward/rightward direction of the pair of the side walls 34. The second blade support portion 69 supports the second blade 70.

The second blade 70 is an integral member including a main portion 71 and a regulation portion 72 as an example of a second contacting portion. The second blade 70 forms a penetration hole (not shown) facing a communication hole 73 as will be described later.

The main portion 71 has a plate shape elongated in the leftward/rightward direction and extending in the frontward/rearward direction. The main portion 71 has a front end portion fixed on a lower face of a rear end portion of the second blade support portion 69. The main portion 71 has a rear end portion facing a lower end portion of the supply roller 3. That is, the main portion 71 extends to the supply roller 3 from the front end portion. The front end portion of the main portion 71 is an example of a second fixed portion.

The regulation portion 72 has a generally L-shaped cross-section continuous with the rear end portion of the main portion 71 and bending upward to the supply roller shaft 3A. The regulation portion 72 has an end portion entering the brush portion 3B of the supply roller 3. That is, the regulation portion 72 is in contact with the brush portion 3B at a position upstream of the contact portion N in the rotating direction of the supply roller 3. Here, the contact portion N is a contacting portion between the developing roller 2 and the supply roller 3.

The partition wall 67 is positioned below the supply roller 3 in an intermediate portion in the upward/rearward direction of the developing unit 61. The partition wall 67 has a generally plate shape extending in the frontward/rearward direction. The partition wall 67 has a front end portion positioned blow a rear end portion of the second blade 70, and has a rear end portion positioned frontward of and spaced away from an upper end portion of the rear wall 65.

The developing unit frame 62 defines a first part P1, which is demarcated by the developing roller 2, the supply roller 3, the thickness-regulating blade 4, the second blade 70, the pair of the side walls 63, and the front wall 66. Additionally, the developing unit frame 62 also defines a second part P2, which is an area rearward of the supply roller 3 and below the partition wall 67.

(2-2) Conveyance of Toner

The developing unit 61 is formed with the communication hole 73 and further includes a screw 74 as an example of a conveying member. The communication hole 73 is positioned at a substantially intermediate portion in the leftward/rightward direction of a lower wall of the second blade support portion 69. The communication hole 73 vertically penetrates the lower wall of the second blade support portion 69.

The screw 74 is positioned frontward of the supply roller 3 and above the lower wall of the second blade support portion 69. That is, the screw 74 is positioned lower than the developing roller 2. The screw 74 is an auger screw extending in the leftward/rightward direction. The screw 74 has a right half portion having a left-hand thread or helix and a left half portion having a right-hand thread or helix. The screw 74 has a left end portion rotatably supported by the left side wall 63, and has a right end portion rotatably supported by the right side wall 63.

(3) Operation in Developing Unit

Upon starting the image forming operation, toner in the toner accommodating portion 6 is supplied to the supply roller 3 through between a rear end portion of the partition wall 67 and the rear wall 65, as the agitator 7 rotates in the clockwise direction when viewed from the left side.

Next, the toner is carried by the brush portion 3B of the supply roller 3. Part of the toner on the brush portion 3B is regulated by the regulation portion 72 of the second blade 70 to a constant amount, as the supply roller 3 rotates in the counterclockwise direction when viewed from the left side.

Subsequently, the toner that is not scraped by the regulation portion 72 but remaining on the brush portion 3B is charged with a positive polarity by the triboelectric charging at the contact portion N between the developing roller 2 and the supply roller 3. The toner is thus carried on the surface of the developing roller body 2B.

The toner on the developing roller body 2B is regulated to a constant thickness by the contact part 54 of the thickness-regulating blade 4, as the developing roller 2 rotates in the counterclockwise direction when viewed from the left side.

Simultaneously, the toner scraped from the surface of the developing roller body 2B is accumulated on a space in front of the supply roller 3, i.e. accumulated in the first part P1.

The toner accumulated at the front side of the supply roller 3 is conveyed to an intermediate portion in the leftward/rightward direction by the screw 74, and is then supplied to the upper end portion of the toner accommodating portion 6, i.e. the second part P2, thorough the communication hole 73 and the penetration hole (not shown) of the second blade 70.

(4) Operational Advantages (4-1) In the developing unit 61 according to the second embodiment, as shown in FIG. 3, the screw 74 is positioned lower than the developing roller 2. Accordingly, the toner scraped by the thickness-regulating blade 4 from the developing roller 2 can be moved by gravity downward of the developing roller 2. This geometry can prevent the toner scraped from the developing roller 2 from being resupplied to the developing roller 2 before returning to the toner accommodating portion 6.

(4-2) In the developing unit 61 according to the second embodiment, the toner accommodating portion 6 is positioned below the developing roller 2 as shown in FIG. 3. Accordingly, the toner must be supplied from the toner accommodating portion 6 to the developing roller 2 against gravity, and therefore may cause problems, such as shortage or instability of the toner supply to the developing roller 2. However, in the developing unit 61 according to the second embodiment, the supply roller 3 has the brush portion 3B. Accordingly, the brush portion 3B can convey a sufficient amount of the toner, and therefore can supply a sufficient amount of the toner to the developing roller 2.

Moreover, the second blade 5 can regulate the toner on the brush portion 3B to a constant amount. Accordingly, stabilized amount of the toner can be supplied to the developing roller 2 from the supply roller 3.

Accordingly, the amount of the toner supplied to the developing roller 2 from the supply roller 3 can be stabilized.

(4-3) Additionally, the developing unit 61 according to the second embodiment can provide further advantages the same as those of the developing unit 31 according to the first embodiment.

7. Third Embodiment

A developing unit 81 according to a third embodiment of the present invention will next be described with reference to FIGS. 5 and 6 wherein like parts and components are designated by the same reference numerals as those shown in FIGS. 1 and 2 to avoid duplicating description.

(1) Outline of the Third Embodiment

Figure 5:
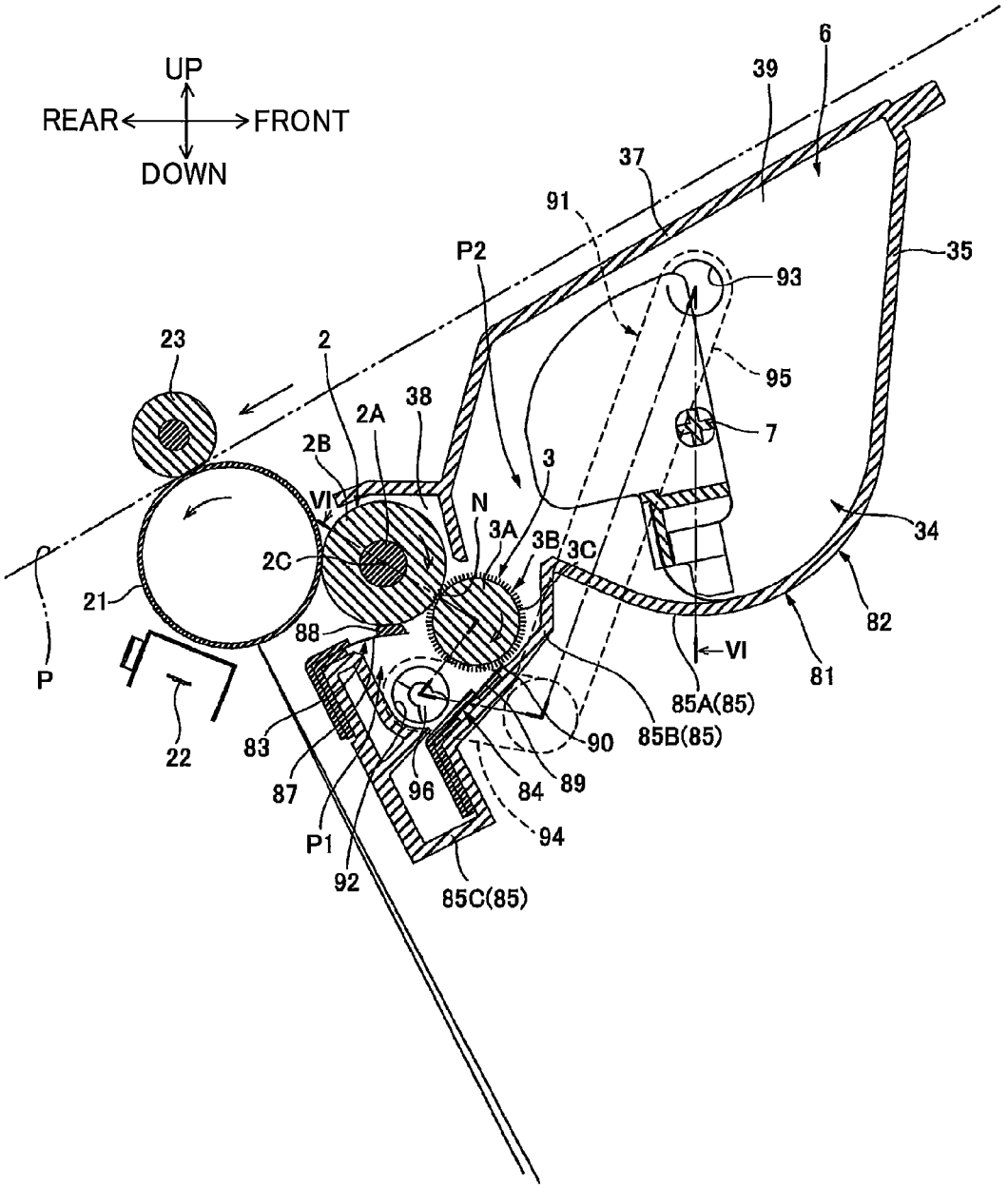
FIG. 5 is a view for description of a developing unit according to a third embodiment of the present invention.
Figure 6:
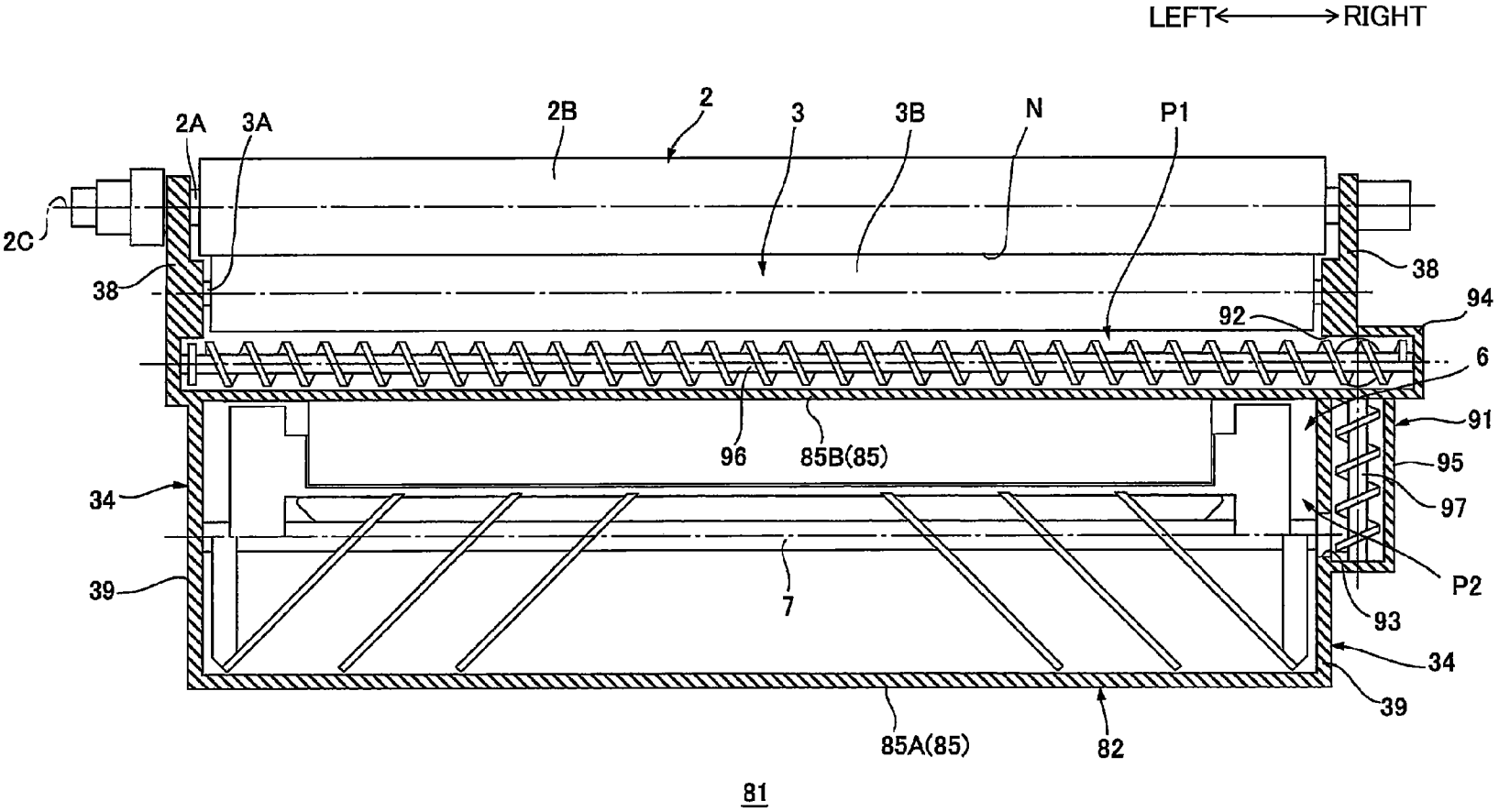
FIG. 6 is a cross-sectional view of the developing unit taken along a line VI-VI in FIG. 5.

The developing unit 81 according to the third embodiment is applied to an image forming apparatus that conveys the sheet P rearward in an upper portion of the developing unit 1 as shown in FIG. 5, whereas the developing unit 1 according to the first embodiment is applied to the image forming apparatus 11 that conveys the sheet P rearward in the lower portion of the developing unit 1.

(2) Detailed Structure of the Developing Unit

The developing unit 81 according to the third embodiment includes a developing unit frame 82 having a lower wall 85. The lower wall 85 is an integral member including a first wall 85A, a second wall 85B, and a third wall 85C. The lower wall 85 supports a thickness-regulating blade 83 and a second blade 84.

The first wall 85A constitutes a front half portion of the developing unit frame 82, similarly to the first wall 36A of the lower wall 36 of the first embodiment. The first wall 85A has a generally arcuate-shaped cross-section, and also has a substantially intermediate portion in the frontward/rearward direction protruding downward. The first wall 85A has left and right portions each being continuous with each lower end portion of the second walls 39 of the pair of side walls 34. The first wall 85A constitutes a bottom wall of the toner accommodating portion 6.

The second wall 85B is positioned rearward of the first wall 85A. The second wall 85B is continuous with and extends downward from a rear end portion of the first wall 85A, and bends downward and diagonally rearward. The second wall 85B has left and right end portions each being continuous with each front lower end portion of the first walls 38 of the pair of the side walls 34.

The third wall 85C is positioned rearward of the second wall 85B, and has a rectangular cross-section. The third wall 85C extends downward from a rear end portion of the second wall 85B, and has a lower end portion bent rearward. The third wall 85C has a rear end portion bent upward from the lower end portion, and has a rear upper end portion positioned rearward and downward of the developing roller 2. The third wall 85C has a left and right end portions each being continuous with each rear lower end portion of the first walls 38 of the pair of the side walls 34.

The thickness-regulating blade 83 has a main portion 87 and a contact part 88 as an example of a first contacting portion.

The main portion 87 has a generally plate shape extending in the frontward/rearward direction and elongated in the leftward/rightward direction. The main portion 87 has a rear end portion fixed on an upper face of a rear upper end portion of the third wall 85C. The main portion 87 has a front end portion facing a lower end portion of the developing roller body 2B. The rear end portion of the main portion 87 is an example of a first fixed portion.

The contact part 88 is positioned on an upper face of a front end portion of the main portion 87. The contact part 88 extends in the leftward/rightward direction, and has an upper end portion forming a generally arcuate-shaped cross-section. The contact part 88 is in contact with the lower end portion of the developing roller body 2B. That is, the contact part 88 is in contact with the developing roller body 2B at a position downstream of a contact portion N in the rotating direction of the developing roller 2. Here, the contact portion N is a contacting portion between the developing roller 2 and the supply roller 3, and the rotating direction of the developing roller 2 is the clockwise direction when viewed from the left side.

The second blade 84 is an integral member including a main portion 89 and a regulation portion 90 as an example of a second contacting portion.

The main portion 89 has a substantially plate shape extending in the front upward/rear downward direction and elongated in the leftward/rightward direction. The main portion 89 has a rear lower end portion fixed on an upper face of a connecting portion between the second wall 85B and the third wall 85C. The main portion 89 has a front upper end portion facing a lower end portion of the supply roller 3. That is, the main portion 89 extends from its rear lower end portion to the supply roller 3. The rear lower end portion of the main portion 89 is an example of a second fixed portion.

The regulation portion 90 has a generally L-shaped cross-section extending from a front upper end portion of the main portion 89 and bending toward the supply roller shaft 3A. The regulation portion 90 has a free end portion entering the brush portion 3B. That is, regulation portion 90 is in contact with the brush portion 3B at a position upstream of the contact portion N in the rotating direction of the supply roller 3. Here, the contact portion N is a contacting portion between the developing roller 2 and the supply roller 3.

The developing unit frame 82 defines a first part P1, which is an area demarcated by the developing roller 2, the supply roller 3, the thickness-regulating blade 83, the second blade 84, the pair of the side walls 34, and the third wall 85C of the lower wall 85. Additionally, the developing unit frame 82 forms a second part P2, which is an area frontward and upward of the supply roller 3 in the developing unit frame 82.

(3) Conveyance of Toner

The developing unit 81 further includes a conveying unit 91 as an example of a communication portion.

The conveying unit 91 is positioned outward of the right side wall 34, i.e. rightward of the right side wall 34. The conveying unit 91 has a first opening 92 and a second opening 93, and includes a first conveying portion 94, a second conveying portion 95, a first screw 96 as an example of a first conveying member, and a second screw 97 as an example of a second conveying member.

The first opening 92 is located at a substantially intermediate portion in the upward/downward direction of the first wall 38 of the right side wall 34, and is positioned rearward and upward of the supply roller 3 and downward of the developing roller 2. The first opening 92 is substantially circular shaped in the side view, and penetrates the right first wall 38 in the leftward/rightward direction.

The second opening 93 is located at a substantially upper end portion and intermediate portion in the frontward/rearward direction of the second wall 39 of the right side wall 34. The second opening 93 is substantially circular shaped in the side view, and penetrates the right second wall 39 in the leftward/rightward direction.

The first conveying portion 94 has a generally cylindrical shape extending in the frontward/rearward direction. The first conveying portion 94 has a closed right end portion, and has an open left end portion communicating with the first opening 92.

The second conveying portion 95 is generally cylindrical shaped. The second conveying portion 95 is continuous with a front lower end portion of the first conveying portion 94, and extends forward and upward from the front lower end portion. The second conveying portion 95 has a rear lower end portion communicating with the front lower end portion of the first conveying portion 94, and has a front upper end portion communicating with the second opening 93.

The first screw 96 is positioned rearward and downward of the supply roller 3 and downward of the developing roller 2. The first screw 96 is an auger screw extending in the leftward/rightward direction having right-hand thread or helix. The first screw 96 has a left end portion rotatably supported by the left side wall 34, and has a right end portion rotatably supported by the right wall of the first conveying portion 94.

The second screw 97 is disposed in the second conveying portion 95. The second screw 97 is an auger screw extending in the rear downward/front upward direction having right-hand thread or helix. The second screw 97 has a front upper end portion that is rotatably supported by a front upper wall of the second conveying portion 95, and has a rear lower end portion that is rotatably supported by a rear lower wall of the second conveying portion 95.

(4) Operation in Developing Unit

Upon starting the image forming operation, toner in the toner accommodating portion 6 is supplied to the supply roller 3, as the agitator 7 rotates in the clockwise direction when viewed from the left side.

Next, the toner is carried by the brush portion 3B of the supply roller 3. Part of the toner on the brush portion 3B is regulated by the regulation portion 90 of the second blade 84 to a constant amount, as the supply roller 3 rotates in the clockwise direction when viewed from the left side.

Subsequently, the toner that is not scraped by the regulation portion 90 but remaining on the brush portion 3B is charged with a positive polarity by the triboelectric charging at the contact portion N between the developing roller 2 and the supply roller 3. The toner is thus carried on the surface of the developing roller body 2B.

The toner on the surface of the developing roller body 2B is regulated to a constant thickness by the contact part 88 of the thickness-regulating blade 83, as the developing roller 2 rotates in the clockwise direction when viewed from the left side.

Simultaneously, the toner scraped from the surface of the developing roller body 2B is accumulated on a space rearward and downward of the supply roller 3, i.e. accumulated in the first part P1.

The toner accumulated rearward and downward of the supply roller 3 is conveyed rightward by the first screw 96, and is then supplied to the first conveying portion 94 thorough the first opening 92.

The toner supplied to the first conveying portion 94 can be moved by gravity to a rear lower end portion of the second conveying portion 95, and then conveyed frontward and upward. Next, the toner is supplied through the second opening 93 into the upper end portion of the toner accommodating portion 6, i.e. the second part P2.

(5) Operational Advantages

The developing unit 81 according to the third embodiment can provide advantages the same as those of the developing unit 31 according to the first embodiment.

8. Fourth Embodiment

A developing unit 101 according to a fourth embodiment of the present invention will next be described with reference to FIGS. 7 and 8 wherein like parts and components are designated by the same reference numerals as those shown in FIGS. 1 and 2 to avoid duplicating description.

(1) Outline of the Fourth Embodiment

The developing unit frame 62 according to the second embodiment is an integral member including the toner accommodating portion 6.

Figure 7:
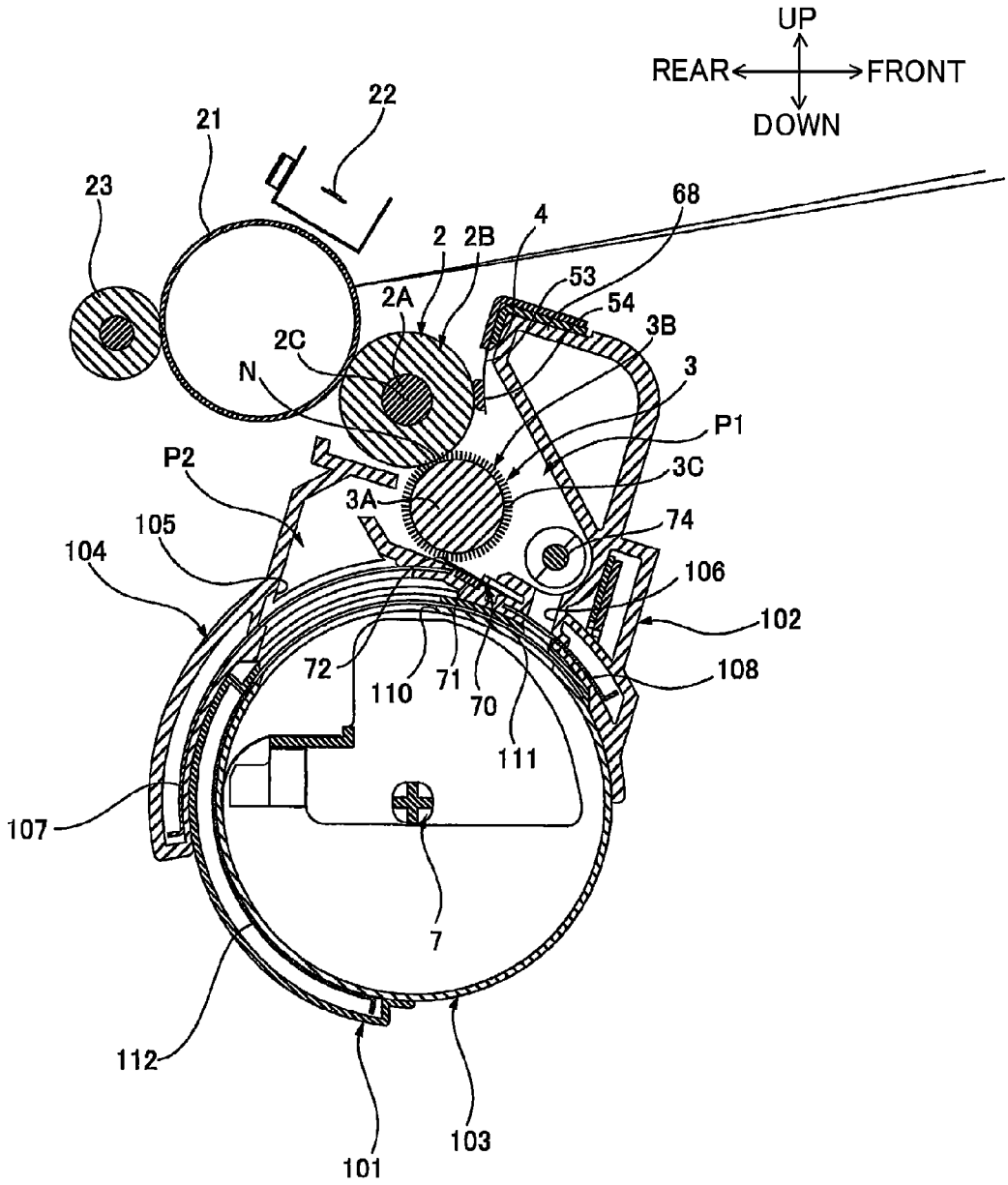
FIG. 7 is a view for description of a developing unit according to a fourth embodiment of the present invention and showing a state where a toner cartridge is attached to a developing unit frame.
Figure 8:
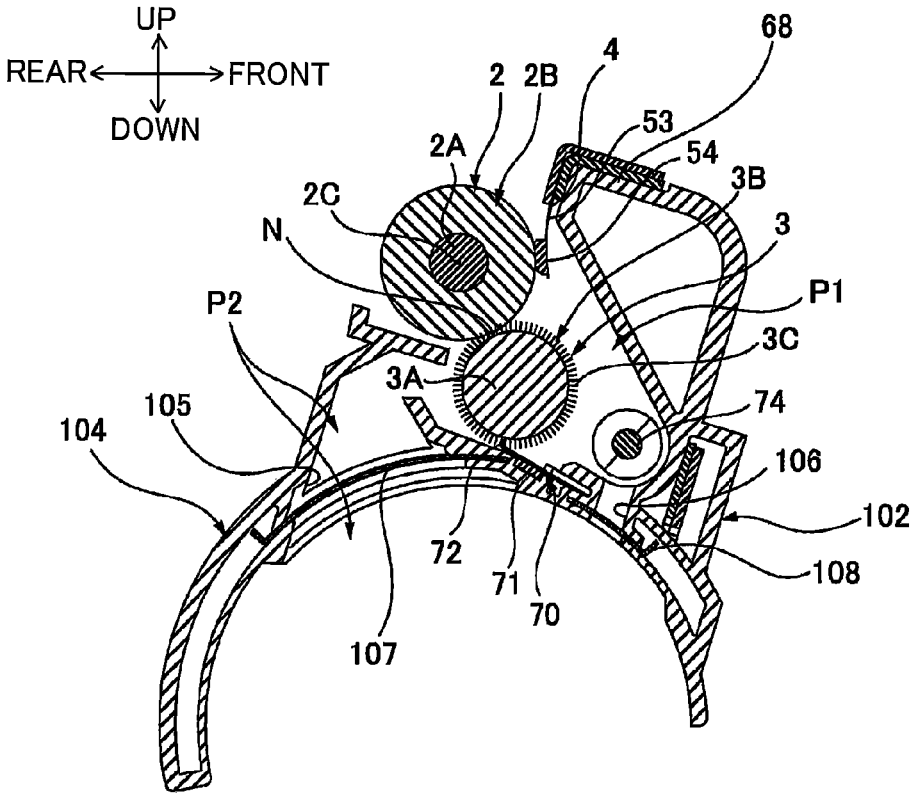
FIG. 8 is a view for description of the developing unit according to the fourth embodiment and showing a state where the toner cartridge is detached from the developing unit frame.
Figure 8:
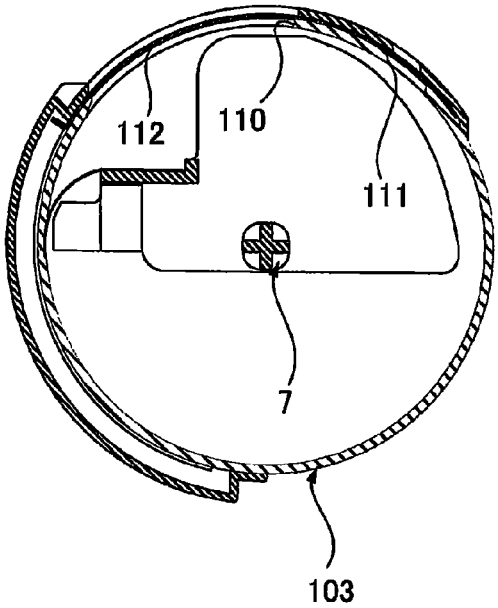

On the contrary to the second embodiment, the developing unit 101 according to the fourth embodiment includes a developing unit frame 102 and a toner cartridge 103, and the toner cartridge 103 is detachable to the developing unit frame 102 as shown in FIGS. 7 and 8.

(2) Detailed Structure of the Developing Unit

The developing unit frame 102 is an example of a housing, and the toner cartridge 103 is an example of a developing agent reservoir.

(2-1) The developing unit frame 102 has a cartridge support portion 104 instead of the toner accommodating portion 6, unlike the developing unit frame 62 according to the second embodiment.

The cartridge support portion 104 constitutes a lower end portion of the developing unit frame 102. The cartridge support portion 104 has a semi-cylindrical shape extending in the leftward/rightward direction. The cartridge support portion 104 forms an open lower end, a supply hole 105, and recovery hole 106 as an example of an communication portion, and includes a first shutter 107 and a second shutter 108.

The supply hole 105 is positioned at a substantially intermediate portion in the frontward/rearward direction of the cartridge support portion 104, and vertically penetrates the cartridge support portion 104. The supply hole 105 communicates with a rear portion of the developing unit frame 102, the rear portion being rearward of the supply roller 3.

The recovery hole 106 is positioned forward of and away from the supply hole 105, and is formed on a front end portion of the cartridge support portion 104. The recovery hole 106 vertically penetrates the cartridge support portion 104, and communicates with a front portion of the developing unit frame 102, the front portion being frontward of the supply roller 3.

The first shutter 107 is supported at a rear half portion of the cartridge support portion 104. The first shutter 107 is a curved plate bent along the curved surface of the cartridge support portion 104 in the frontward/rearward direction. The first shutter 107 is slidable in the frontward/rearward direction between a close position and an open position. Here, the close position is the position of the first shutter 107 that closes the supply hole 105 (FIG. 8), and the open position is a retracted position of the first shutter 107 that is rearward of the supply hole 105 and opens the supply hole 105 (FIG. 7).

The second shutter 108 is supported at the front end portion of the cartridge support portion 104. The second shutter 108 is a curved plate bent along the curved surface of the cartridge support portion 104 in the frontward/rearward direction. The second shutter 108 is slidable in the frontward/rearward direction between a close position and an open position. Here, the close position is a position of the second shutter 108 that closes the recovery hole 106 (FIG. 8), and the open position is a retracted position of the second shutter 108 that is frontward of the recovery hole 106 and opens the recovery hole 106 (FIG. 7).

The developing unit 101 according to the fourth embodiment defines a second part P2, which is an area including the cartridge support portion 104 and a rear portion of the developing unit frame 102 with respect to the supply roller 3.

(2-2) Toner Cartridge

The toner cartridge 103 is detachably supported by the cartridge support portion 104 of the developing unit frame 102 in a lower end portion of the developing unit 101. The toner cartridge 103 has a generally cylindrical shape extending in the leftward/rightward direction, and has a supply hole 110, a recovery hole 111, and a shutter 112.

The supply hole 110 is positioned at an upper end portion and a generally intermediate portion in the frontward/rearward direction of the toner cartridge 103. The supply hole 110 vertically penetrates an upper peripheral wall of the toner cartridge 103, and is communicable with the supply hole 105 of the developing unit frame 102.

The recovery hole 111 is positioned frontward of and spaced away from the supply hole 110, and is formed on a front upper end portion of the toner cartridge 103. The recovery hole 111 vertically penetrates an upper peripheral wall of the toner cartridge 103, and is communicable with the recovery hole 106 of the developing unit frame 102.

The shutter 112 is supported by the upper end portion of the toner cartridge 103. The shutter 112 is a curved plate bent along the curved peripheral surface of the toner cartridge 103. The shutter 112 is slidable in the frontward/rearward direction between a close position and an open position. Here, the close position is a position of the shutter 112 that closes the supply hole 110 and the recovery hole 111 (FIG. 8), and the open position is a retracted position of the shutter 112 that is rearward and downward of the supply hole 110 and opens the supply hole 110 and the recovery hole 111 (FIG. 7).

(3) Attachment and Detachment of the Toner Cartridge

For attaching the toner cartridge 103 to the developing unit frame 102, firstly, the toner cartridge 103 is attached to the cartridge support portion 104 of the developing unit frame 102 as shown in FIG. 7. Secondly, the first shutter 107 and the second shutter 108 of the developing unit frame 102 are respectively moved to the open positions, and the shutter 112 of the toner cartridge 103 is also moved to the open position.

For detaching the toner cartridge 103 from the developing unit frame 102, firstly, the first shutter 107 and the second shutter 108 of the developing unit frame 102 are respectively moved to the close positions as shown in FIG. 8. The shutter 112 of the toner cartridge 103 is also moved to the close position. Secondly, the toner cartridge 103 is detached from the cartridge support portion 104 of the developing unit frame 102.

(4) Operation of the Developing Unit

Upon starting the image forming operation, toner in the toner cartridge 103 is supplied to the supply roller 3 sequentially through the supply hole 110 of the toner cartridge 103 and the supply hole 105 of the cartridge support portion 104, as the agitator 7 rotates in the clockwise direction when viewed from the left side.

Next, the toner is carried by the brush portion 3B of the supply roller 3. Part of the toner on the brush portion 3B is regulated by the regulation portion 72 of the second blade 70 to a constant amount, as the supply roller 3 rotates in the counterclockwise direction when viewed from the left side.

Subsequently, the toner that is not scraped by the regulation portion 72 but remaining on the brush portion 3B is charged with a positive polarity by the triboelectric charging at the contact portion N between the developing roller 2 and the supply roller 3. The toner is thus carried on the surface of the developing roller body 2B.

The toner on the developing roller body 2B is regulated to a constant thickness by the contact part 54 of the thickness-regulating blade 4, as the developing roller 2 rotates in the counterclockwise direction when viewed from the left side.

Simultaneously, the toner scraped from the surface of the developing roller body 2B is accumulated on a space in front of the supply roller 3, i.e. accumulated in the first part P1.

The toner accumulated at the front side of the supply roller 3 is conveyed to the intermediate portion in the leftward/rightward direction by the screw 74, and is then supplied to the upper end portion of the toner cartridge 103 sequentially thorough the recovery hole 106 of the cartridge support portion 104 and the recovery hole 111 of the toner cartridge 103.

(5) Operational Advantages

The developing unit 101 according to the fourth embodiment can provide advantages the same as those of the developing unit 61 according to the second embodiment.

While the present invention has been described in detail with reference to the embodiments thereof, it would be apparent to those skilled in the art that various changes and modifications may be made therein without departing from the spirit of the invention.

What is claimed is:

1. A developing device comprising:

a housing including a developing agent reservoir configured to accommodate a developing agent;

a developing roller having a rotational axis extending in a first direction and a first outer peripheral surface configured to carry the developing agent thereon, the developing roller being supported by the housing and rotatable about the rotational axis in a first rotating direction;

a supply roller comprising:

a core member having a second outer peripheral surface and extending in parallel to the rotational axis, the core member being supported by the housing and rotatable in a second rotating direction; and a brush portion containing fibers implanted on the second outer peripheral surface and configured to contact the developing roller to supply the developing agent in the developing agent reservoir to the developing roller, a contact portion being defined between the brush portion and the developing roller;

a first regulating member having a first fixed portion fixed to the housing, and a first contacting portion contacting the first outer peripheral surface at a position downstream of the contact portion in the first rotating direction and upstream, in the first rotating direction of a developing position where the developing agent is to be supplied to a photosensitive drum, the first contacting portion being configured to regulate the developing agent on the first outer peripheral surface to a constant thickness;

a second regulating member having a second fixed portion fixed to the housing, and a second contacting portion contacting the brush portion at a position upstream of the contact portion in the second rotating direction, the second contacting portion being configured to regulate the developing agent on the supply roller to a constant amount, the housing having a first part positioned downstream of the second regulating member in the second rotating direction of the supply roller and upstream of the first regulating member in the first rotating direction of the developing roller, and a second part positioned upstream of the second regulating member in the second rotating direction of the supply roller;

a communication portion configured to provide communication between the first part positioned downstream of the second regulating member in the second rotating direction of the supply roller and upstream of the first regulating member in the first rotating direction of the developing roller, and the second part positioned upstream of the second regulating member in the second rotating direction of the supply roller; and a conveying member positioned in the first part and configured to convey the developing agent in the first part to the communication portion in the first direction in which the rotational axis of the developing roller extends.

2. The developing device according to claim 1, wherein the developing agent reservoir has an upper portion; and wherein the communication portion is configured to provide communication between the first part and the upper portion.

3. The developing device according to claim 1, wherein the housing has an end portion in the first direction;

wherein the communication portion is provided at the end portion; and wherein the conveying member is configured to convey the developing agent in the first part toward the end portion.

4. The developing device according to claim 1, wherein the conveying member is positioned lower than the developing roller.

5. The developing device according to claim 1, further comprising a second conveying member positioned in the communication portion and configured to convey the developing agent in the communication portion to the second part.

6. The developing device according to claim 1, wherein the second regulating member has a main portion extending to the supply roller from the second fixed portion; and wherein the second contacting portion is continuous with the main portion, and bends toward the core member to enter the brush portion.

7. The developing device according to claim 1, wherein the first rotating direction is coincident with the second rotating direction.

8. A developing device comprising:

a housing;

a developing agent reservoir detachably supported by the housing and configured to accommodate a developing agent;

a developing roller having a rotational axis extending in a first direction and a first outer peripheral surface configured to carry the developing agent thereon, the developing roller being supported by the housing and rotatable about the rotational axis in a first rotating direction;

a supply roller comprising:

a core member having a second outer peripheral surface and extending in parallel to the rotational axis, the core member being supported by the housing and rotatable in a second rotating direction; and a brush portion containing fibers implanted on the second outer peripheral surface and configured to contact the developing roller to supply the developing agent in the developing agent reservoir to the developing roller, a contact portion being defined between the brush portion and the developing roller;

a first regulating member having a first fixed portion fixed to the housing, and a first contacting portion contacting the first outer peripheral surface at a position downstream of the contact portion in the first rotating direction and upstream, in the first rotating direction of a developing position where the developing agent is to be supplied to a photosensitive drum, the first contacting portion being configured to regulate the developing agent on the first outer peripheral surface to a constant thickness;

a second regulating member having a second fixed portion fixed to the housing, and a second contacting portion contacting the brush portion at a position upstream of the contact portion in the second rotating direction, the second contacting portion being configured to regulate the developing agent on the supply roller to a constant amount, the housing having a first part positioned downstream of the second regulating member in the second rotating direction of the supply roller and upstream of the first regulating member in the first rotating direction of the developing roller, and a second part positioned upstream of the second regulating member in the second rotating direction of the supply roller;

a communication portion configured to provide communication between the first part positioned downstream of the second regulating member in the second rotating direction of the supply roller and upstream of the first regulating member in the first rotating direction of the developing roller, and the second part positioned upstream of the second regulating member in the second rotating direction of the supply roller; and a conveying member positioned in the first part and configured to convey the developing agent in the first part to the communication portion in the first direction in which the rotational axis of the developing roller extends.

9. The developing device according to claim 8, wherein the developing agent reservoir has an upper portion; and wherein the communication portion is configured to provide communication between the first part and the upper portion.

10. The developing device according to claim 8, wherein the housing has an end portion in the first direction;

wherein the communication portion is provided at the end portion; and wherein the conveying member is configured to convey the developing agent in the first part toward the end portion.

11. The developing device according to claim 8, wherein the conveying member is positioned lower than the developing roller.

12. The developing device according to claim 8, wherein the second regulating member has a main portion extending to the supply roller from the second fixed portion; and wherein the second contacting portion is continuous with the main portion, and bends toward the core member to enter the brush portion.

13. The developing device according to claim 8, wherein the first rotating direction is coincident with the second rotating direction.

* * * * *